US005096058A

United States Patent [19]

Juravin et al.

[11] Patent Number: 5,096,058

[45] Date of Patent: Mar. 17, 1992

[54] COMBINED GREETING CARD AND CANDY HOLDER

[75] Inventors: Adi D. Juravin, 2429 Third Ave. S., Apt. B-24, Minneapolis, Minn. 55404; Olaf A. Bjorkeda, Buffalo, Minn.

[73] Assignee: Adi D. Juravin, Minneapolis, Minn.

[21] Appl. No.: 612,231

[22] Filed: Nov. 13, 1990

[51] Int. Cl.[5] ..... B65D 69/00; B65D 5/00; G09F 1/00

[52] U.S. Cl. ..... 206/232; 229/152; 40/124.1

[58] Field of Search ..... 206/232, 45.11; 40/124.1; 229/152

[56] References Cited

U.S. PATENT DOCUMENTS

| | | | |
|---|---|---|---|
| 1,143,729 | 5/1915 | Schmidt | 206/232 |
| 1,917,120 | 7/1933 | Howell, Jr. | 229/152 |
| 2,314,721 | 3/1943 | Lowenstein | 40/124.1 |
| 2,366,226 | 1/1945 | Williamson | 229/152 |
| 2,799,391 | 7/1957 | Eisner | 206/232 |
| 3,835,987 | 9/1974 | Growney | 229/152 |
| 4,433,780 | 2/1984 | Ellis | 206/232 |

FOREIGN PATENT DOCUMENTS

| | | | |
|---|---|---|---|
| 2516720 | 10/1976 | Fed. Rep. of Germany | 206/232 |

*Primary Examiner*—Paul T. Sewell
*Assistant Examiner*—Marie D. Patterson
*Attorney, Agent, or Firm*—Moore & Hansen

[57] ABSTRACT

A Combined Greeting Card and Candy Holder of foldable construction having a relatively flat, compact candy-receiving and containing compartment defined by front and back panels and opposed side panels. A message panel is hingedly connected to one of the front or back panels of the candy compartment so as to be folded over the candy compartment in a greeting card type of arrangement. An openable closure is provided on the candy compartment so as to permit quick and convenient access to its interior for inserting and removing a piece of candy as a gift to be included with the greeting card.

2 Claims, 3 Drawing Sheets

COMBINED GREETING CARD AND CANDY HOLDER

BACKGROUND OF THE INVENTION

This invention relates to a greeting card which is so formed as to provide a candy-containing compartment, yet to be foldable into a substantially flat configuration well adapted for placement in an envelope.

Display and greeting cards having some type of receptacle for containing candy are known. For example, U.S. Pat. No. 4,938,344 discloses a "stand-up" type of collapsible display made from a single piece of scored and foldable material, such as cardboard. One panel of the two-panel construction is folded back over the other to form a candy receptacle having an access opening or window in the other panel. However, the device is shipped and stored in a flat condition, and candy is placed in the relatively bulky, open-ended candy receptacle only after the device is assembled for use. Such a device thus does not lend itself to use as a greeting card capable of being folded to a substantially flat condition, even with an item of candy contained in it, for display on conventional greeting card racks and reception in an envelope U.S. Pat. No. 4,951,404 discloses a greeting or display card of foldable, two-panel construction in which a cutout in a front panel houses a transparent container for holding ornamental objects The transparent container is made from an acrylic material to provide a traylike cavity, and must be separately formed and assembled prior to attachment within a cut-out window in the card front panel by two-faced adhesive Although the card may be folded closed, it requires a special envelope, is complex and expensive to manufacture from separate plastic and card fiber materials, and permanently seals the ornamental objects in the transparent container. There is thus no provision for the quick and easy insertion and removal of a candy gift in an ordinary one-piece greeting card format.

We have developed a combined greeting card and candy holder which fills the need for such a device not satisfied by prior art items as described above.

BRIEF SUMMARY OF THE INVENTION

The greeting card and candy holder of this invention is particularly distinguished by a one-piece construction formed and folded from a single sheet of material to provide a candy compartment, as well as message display panels, in a particularly simple, effective and inexpensive manner.

These basic objectives are realized by scoring a single sheet blank of material, such as cardboard, reinforced paper, or thin plastic, for folding to form a candy compartment adapted to receive and securely hold a candy item, such as a bar of Swiss chocolate. The candy compartment is comprised of a plurality of panels, one of which preferably has a separate message panel hingedly connected thereto along a fold line connection.

Advantageously, an openable closure is provided on said candy compartment in such a manner as to provide quick and convenient access to its interior for insertion and removal of a candy gift item. As sold and displayed by gift, card, or candy shops, the card will be folded and secured in its fully assembled condition with a candy gift contained within the candy compartment. Thus, no special folding, securing, or assembly is required by the retailer or user.

For ease of handling, display, and mailing in an envelope, the combined greeting card and candy holder will be relatively flat and not bulky in its fully assembled condition with a flat item of candy, such as a chocolate wafer bar inside the candy compartment To that end, the plurality of candy compartment panels includes opposed, relatively closely spaced, front and back longitudinal panels and two opposed side panels cooperating to define a generally flat compartment of rectangular shape. Closure means over the opposite ends of the candy compartment hold the candy bar in place.

The aforesaid openable closure preferably comprises a tuck flap hingedly connected to the outermost, longitudinal side edge of one of said side panels, with the tuck flap being foldable inside one of the front or back panels for easy access to the candy compartment. Alternatively a tuck flap may be hingedly connected to a closure flap connected to one end of either the front or back panel of the candy compartment to provide one of the aforesaid end closure means in the form of an openable closure The other end of the candy compartment may be closed in the same manner by an openable tuck flap; or one or both ends of the candy compartment may be closed by a breakable adhesive seal.

These and other objects and advantages of the invention will be readily understood as the following description is read in conjunction with the accompanying drawings wherein like reference numerals designate like elements throughout the several views.

DESCRIPTION OF THE PREFERRED EMBODIMENTS

Figure 1:
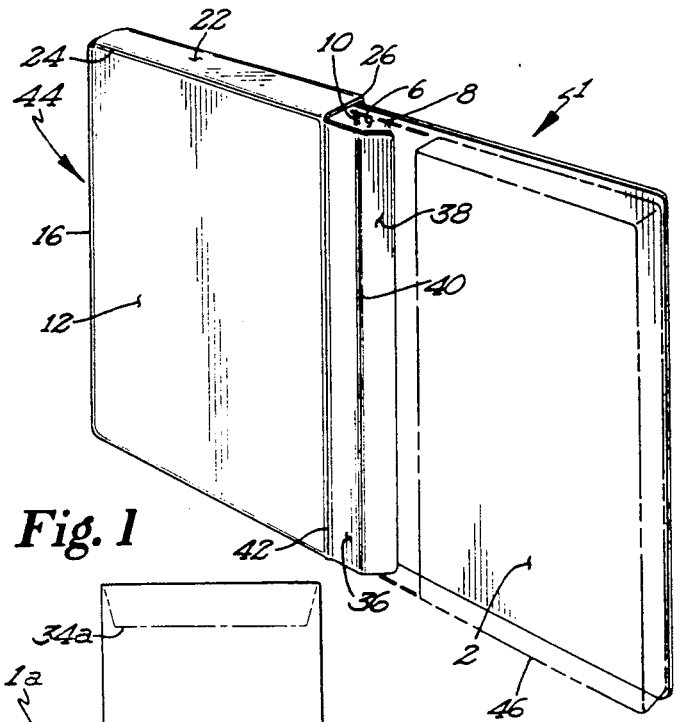
FIG. 1 is a perspective view of the preferred embodiment of the COMBINED GREETING CARD AND CANDY HOLDER OF THIS INVENTION, showing the tuck flap of an openable side closure in an open condition.

With reference to the drawings, FIGS. 1-5 show a first, preferred embodiment of the invention comprising a COMBINED GREETING CARD AND CANDY HOLDER generally indicated by reference numeral 1. It is preferred, but not essential, that the device be made from a single sheet blank of scored and formed material as indicated by reference numeral 1*a* in FIG. 5. The sheet blank may comprise any flexible and bendable material which may be scored and formed so as to be foldable to the desired configuration. For that purpose, lightweight fiberboard, cardboard, or even thin sheets of plastic may be utilized. Sheet blank 1*a* is comprised of a plurality of panels separated by scored fold lines, located to define fold line connections between the various panels as desired Thus, with reference to FIG. 5, the formed and scored sheet blank 1*a* is comprised of a front, message panel 2 separated along fold line connection 8 from a first side panel 6. A second, longitudinal panel 4 is joined to side panel 6 along common, scored, fold line connection 10, with panel 4 eventually being positioned to function as the back panel of a candy-containing compartment 44. Front or inside panel 12 of the candy compartment is separated from back panel 4 by a side panel 14 connected along scored fold lines 16 and 18 to panels 12 and 4, respectively Along the opposite, longitudinal edge 42 of candy compartment front panel 12 is a second side panel 36. Hingedly connected to the outermost, longitudinal side edge 40 of side panel 36 is a tuck flap 38. In this embodiment, side panel 36 serves as a side closure fold panel in combination with tuck flap 38 to provide an openable closure along fold line connection 42 with candy compartment front panel 12. Tuck flap 38 is foldable about its fold line connection 40 with side closure panel 36.

Figure 2:
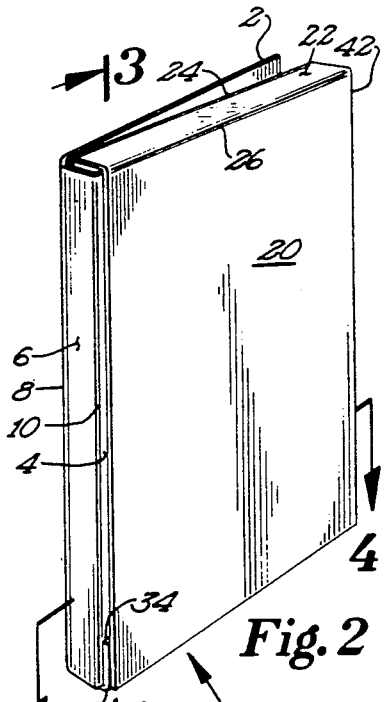
FIG. 2 is a perspective view of the same device shown in FIG. 1, except showing the reverse or back side thereof.

In order to provide closure means over the opposite ends of the candy compartment 44, end closure, fold panels 22 and 28 are provided at the opposite ends of panel 12 and attached thereto along scored, fold line connections 24 and 30, respectively. Connected to bottom, end closure panel 28 along a fold line connection 32 is an outer, glue tuck flap 34. For purposes of providing an end closure over the opposite ends of the candy compartment, and for securing the candy compartment and cart assembly together, a reinforcing, back handle 20 is hingedly connected to top, end closure panel 22 along fold line connection 26 therewith. Elongated reinforcing panel 20 is sized to overlay candy compartment back panel 4 when assembled to its final position of use as shown in FIG. 2. Panel 20 is secured in place by being glued to glue panel 34 along the glue area 34*a* indicated in FIG. 5 at the outer end of panel 20.

Figure 3:
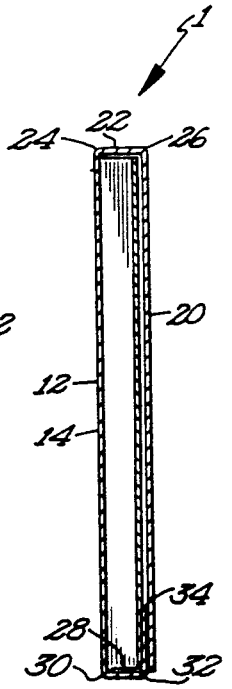
FIG. 3 is a vertical section view of the device of FIG. 2, taken along lines 3—3 thereof.

The blank 1*a* is formed and assembled to the conditions shown in FIGS. 1, 2, and 3 by folding back panel 4 over front panel 12 along fold line connection 16 and 18. Reinforcing panel 20 is then folded downwardly along its fold line connection 26 with top end closure panel 22 so as to be in overlying relation to back panel 4. Bottom end closure panel 28 is then folded upwardly to a horizontal position to close the bottom end of the candy compartment, and its glue flap 34 is folded upwardly along scored fold line connection 32. With glue flap 34 in a position extending generally parallel to front and back panels 12 and 4, reinforcing panel 20 is glued thereto along glue area 34*a*. As may be seen most clearly by reference to FIGS. 2 and 3, glue panel 34 is folded inside of back, reinforcing panel 20 and attached thereto by gluing. It will thus be seen that reinforcing panel 20 extends loosely across the back face of candy compartment back panel 4 to function as a reinforcing belt. The attachment of reinforcing panel 20 to glue panel 34 secures the entire card and candy compartment assembly together in such a way as to form a generally rectangular shaped candy compartment indicated by reference numeral 44 in FIGS. 1 and 4. As may be understood by reference to FIG. 1, access to the interior of candy compartment 44 is readily achieved by opening and closing tuck flap 38 and its attached side closure panel 36. By providing such an openable candy compartment closure means along one longitudinal side edge of the candy compartment, adjacent to message panel 2, a secure yet readily accessible means of access to the interior of the candy compartment is achieved.

Figure 4:
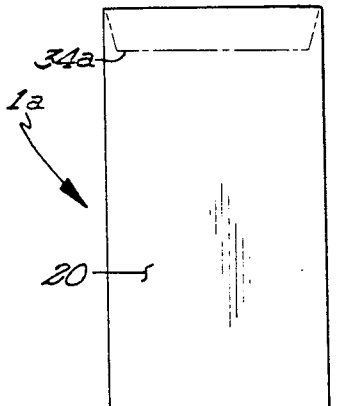
FIG. 4 is a horizontal section view of the device of FIG. 2 taken along lines 4—4 thereof.
Figure 4:
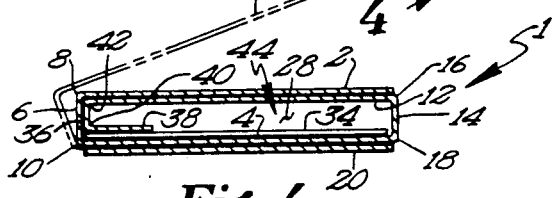
Figure 5:
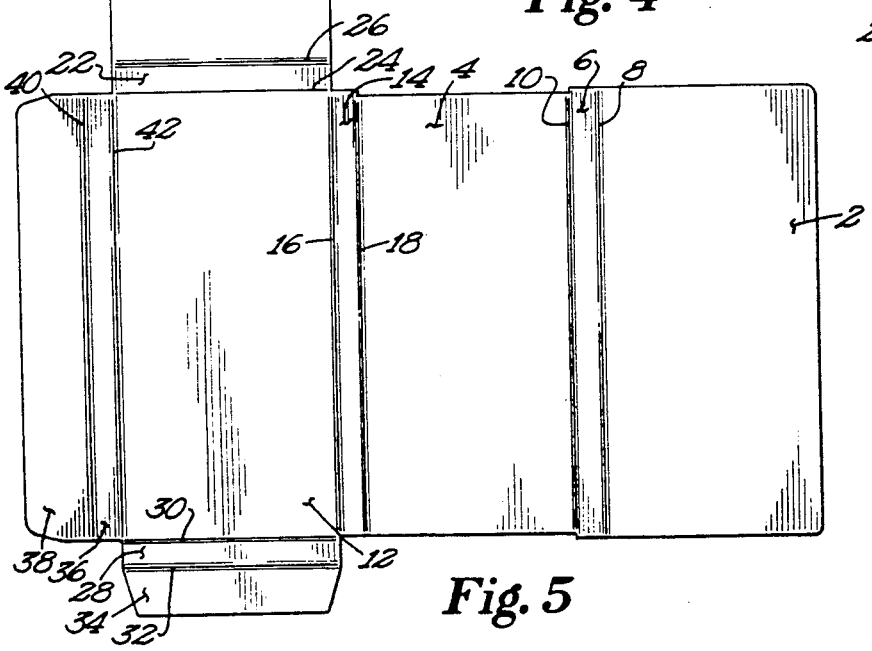
FIG. 5 is a plan view showing the scored sheet blank from which the greeting card and candy holder of FIGS. 1-4 is formed and assembled.

Message panel 2, being hingedly connected to candy compartment back panel 4, along fold line connections 8 and 10 of intermediate side panel 6, may be folded over the candy compartment in generally face-to-face juxtaposition with candy compartment front panel 12, as may be seen by reference to FIGS. 2 and 4. In the thus folded condition of message panel 2, the overall assembly is foldable to a generally flat, compact condition for storage, display, and mailing. Such a generally flat, rectangular shape for the candy compartment 44 permits the insertion of an item of candy as a gift into the candy compartment. The candy item may preferably comprise a high quality, Swiss chocolate wafer bar of flat, rectangular configuration as indicated by reference numeral 46 in FIG. 1. A printed message may be provided on the outside of message panel 2, and a further message either written by hand or printed, may be provided on the outer face of candy compartment front panel 12, so as to be viewable when message panel 2 is folded to the open position shown in FIG. 1. In order to provide a decorative effect, back reinforcing panel 20 may be formed to the shape of a simulated bow.

Figure 6:
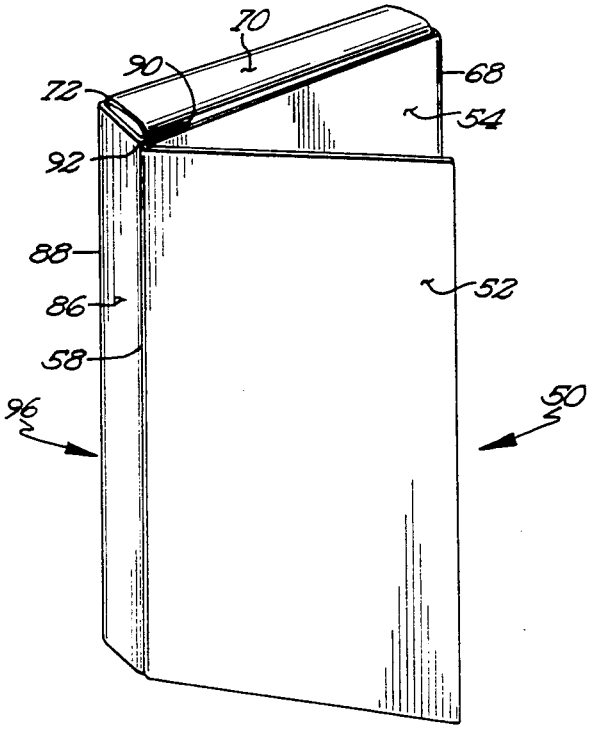
FIG. 6 is a perspective view of a fully assembled second embodiment of the COMBINED GREETING CARD AND CANDY HOLDER of this invention.
Figure 7:
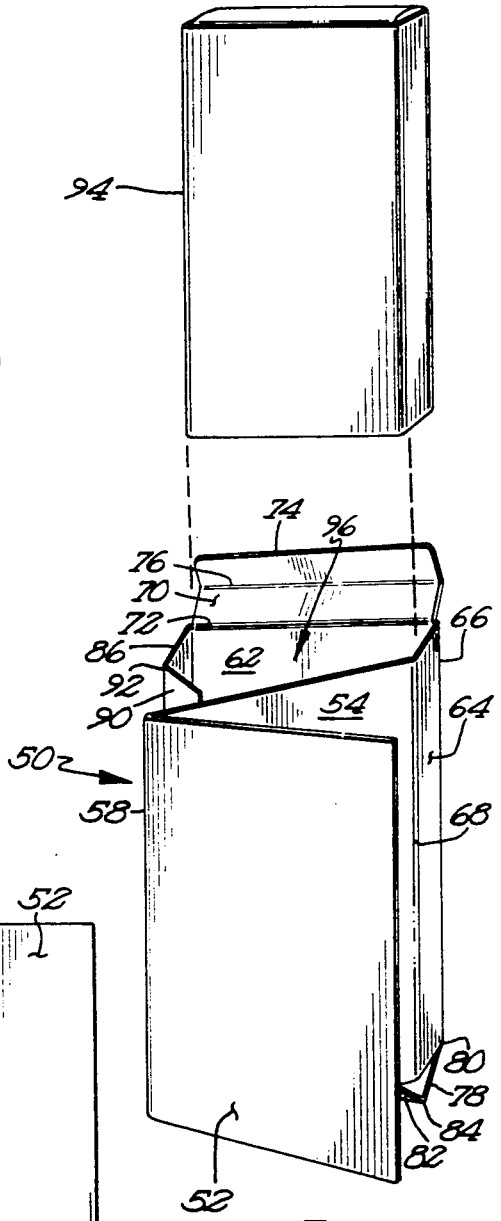
FIG. 7 is a perspective, exploded view showing the device of FIG. 6 is partially assembled condition.
Figure 8:
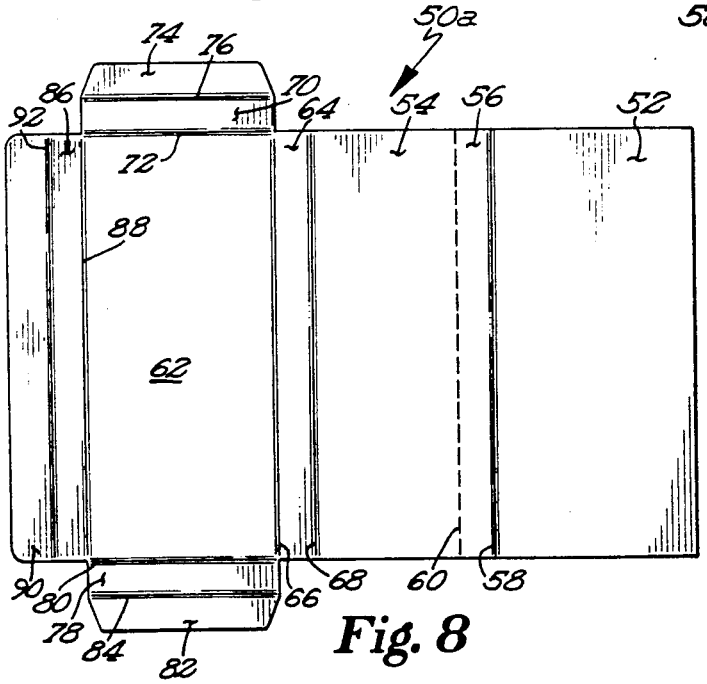
FIG. 8 is a plan view of the stored blank of material from which the devices of FIGS. 6 and 7 is assembled.

FIGS. 6–8 show an alternative embodiment similar to that of FIGS. 1–5, except that the openable access closure for the candy compartment is provided at the opposite ends thereof, rather than along a longitudinal side edge. Thus, the COMBINED GREETING CARD AND CANDY HOLDER 50 of FIGS. 6–8 is formed from a single blank of cut and scored sheet material 50*a* to provide a message panel 52, and front and back candy compartment longitudinal panels 54 and 62. Message panel 52 is connected to candy compartment front or inside panel 54 along fold line connection 58 therewith. Dotted line 60 in FIG. 8 defines with scored fold line 58 a glue area 56 utilized in securing the candy compartment in folded condition as hereinafter set forth. Candy compartment front panel 54 is connected to a first side panel 64 along scored fold line connection 68, with side panel 64 in turn being connected along one longitudinal side edge of candy compartment back panel 62 along fold line connection 66 therewith. Along the opposite, longitudinal side edge 88 of compartment panel 62, a second side panel 86 is foldably connected. Hingedly attached to the outermost, longitudinal side edge of side panel 86 along fold line connection 92 therewith is an attachment flap 90, adapted to be glued to front panel 54 along glue area 56 as described below with respect to FIG. 7.

In order to close the top and bottom ends of the candy compartment, generally indicated by reference numeral 96, top and bottom closure and tuck flaps are provided Top closure flap 70 is hingedly connected to candy compartment back panel 62 along fold line connection 72. A foldable tuck flap 74 is secured to the outer edge of closure flap 70 along scored fold line 76. Similarly, at the bottom of the sheet blank 50*a*, as shown in FIG. 8, a bottom closure flap 78 is hingedly connected along the bottom edge of candy compartment back panel 62 by means of fold line connection 80. A bottom tuck flap 82 is attached to the outer end of bottom closure flap 78 along scored fold line 84.

The cut and scored sheet blank 50*a* is folded and assembled as shown in FIG. 7. Candy compartment front panel 54 is folded over back panel 62 along fold line connections 66 and 68 to position side panel 64 at right angles to the front and back panels 54 and 62. Opposite side panel 86 is folded inwardly along its fold line connection 88 with back panel 68 to a position wherein it serves to close the opposite side of the elongated candy compartment 96. Attachment flap 90 on side panel 86 is then folded inside of front panel 54. Side panel 54 is then folded inwardly to bring its glue area 56 in overlapping relation to attachment panel 90 Those two surfaces are then glued together to secure the assembled candy compartment with spaced-apart, front and back panels 54 and 62 parallel to each other. An item of candy, such as a wafer type of chocolate bar 94, may be inserted into candy compartment 96, and secured therein by folding top and bottom closure and tuck flaps 70, 74 and 78, 82 inwardly with their respective tuck flaps tucked inside of candy compartment front panel 54.

Front, message panel 52 is folded downwardly over the outer or front face of candy compartment front panel 54 in the manner shown in FIGS. 6 and 7 to provide a greeting card type of device of generally flat, rectangular shape. For purposes of compactness, and for accommodating a flat, wafer bar type of candy item, the front to back depth of the candy compartment between front and back panels 54 and 62, i.e., the width of side panels 64 and 86 is preferably on the order of one-quarter inch to one-half inch. The same dimensional considerations for the depth of the candy compartment apply to the embodiment shown in FIGS. 1-5. Messages, either printed or hand written, may be provided on the front face of message panel 52, as well as on the front face of candy compartment front panel 54 and on the inside of message panel 52.

Figure 9:
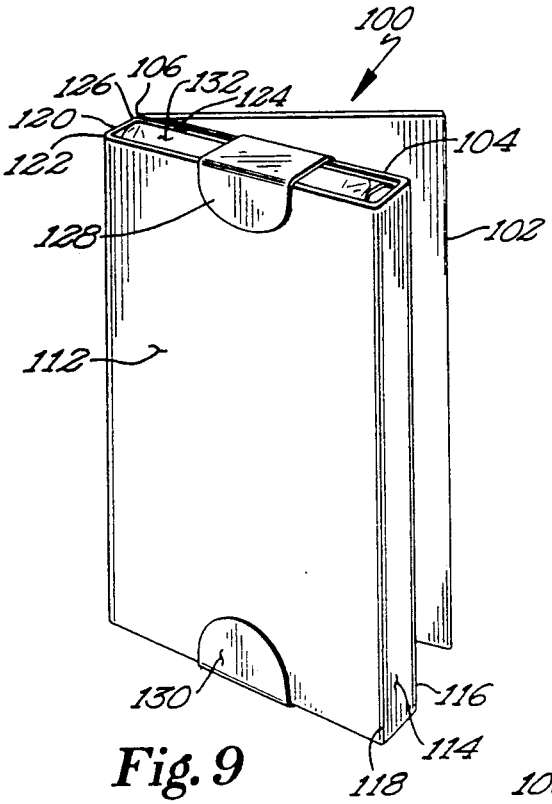
FIG. 9 is a perspective view of the rear side of still another embodiment of the COMBINED GREETING CARD AND CANDY HOLDER of this invention.
Figure 10:
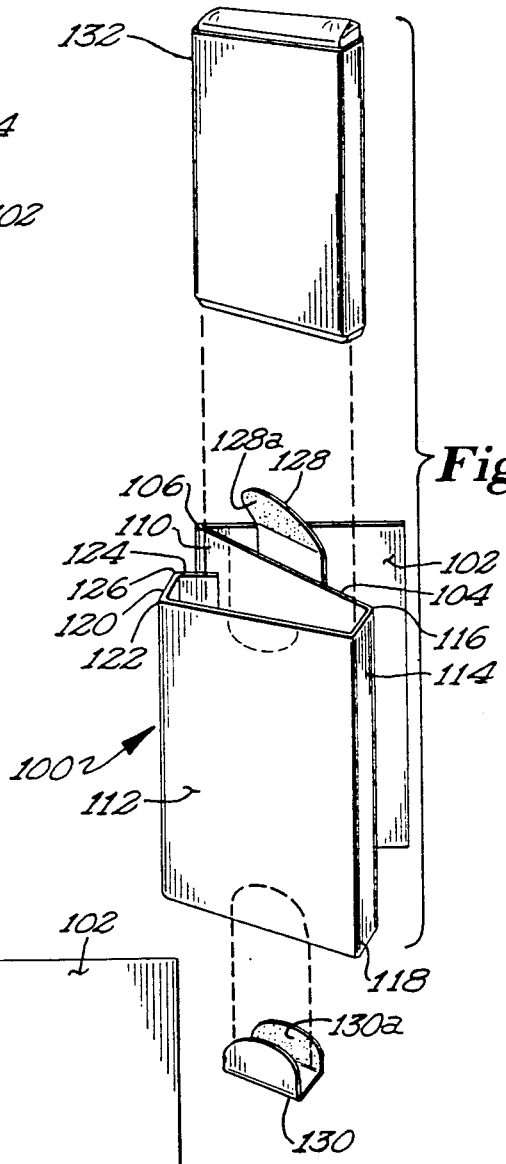
FIG. 10 is a perspective, exploded view of the device of FIG. 9 shown in partially assembled form.
Figure 11:
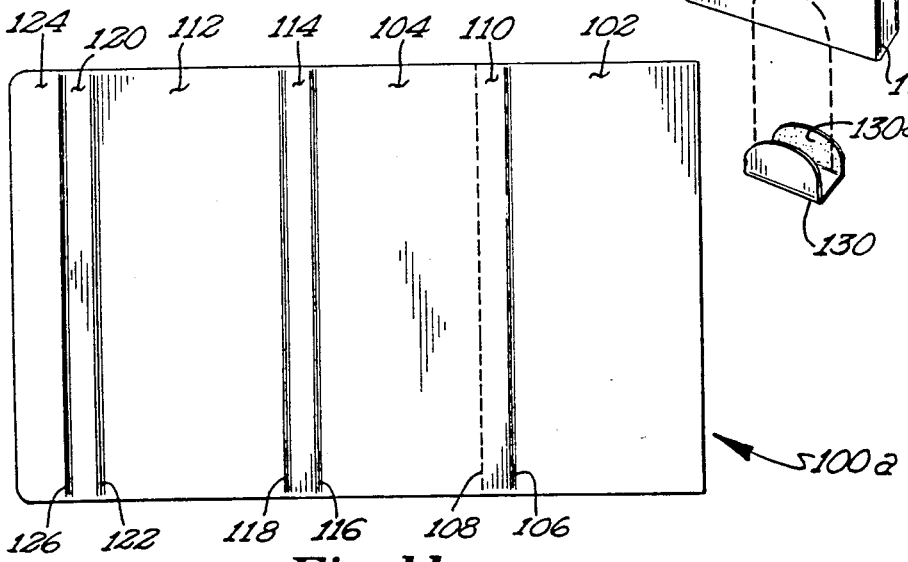
FIG. 11 is a plan view showing the scored sheet blank from which the device of FIGS. 9 and 10 is assembled.

A still further embodiment of the device is shown in FIGS. 9 through 11. The embodiment of the COMBINED GREETING CARD AND CANDY HOLDER shown in those figures is identical to that of FIGS. 6-8 except that the opposite ends of the candy compartment are closed by sticker seals, rather than by tuck flaps. Thus, the GREETING CARD AND CANDY HOLDER 100 of FIGS. 9-11 is preferably formed from a single blank of sheet material 100*a* comprised of a plurality of longitudinally extending, parallel panels 102, 104, and 112. Panel 102 is a front message panel hingedly connected to an inside message panel and candy compartment front panel 104 along scored, fold line connection 106 therewith. Dotted line 108 delineates in combination with scored fold line 106 a glue area 110 for securing the folded and assembled device together Candy compartment front panel 104 is connected along its opposite side edge with a first side panel 114 by means of a fold line connection 116; and side panel 114 is in turn attached to one longitudinal edge of compartment back panel 112 along scored fold line 118. A second side, closure panel 120 is connected along fold line connection 122 to the opposite, longitudinal edge of compartment back panel 112. An attachment flap 124 is provided on the opposite, free end of side panel 120 and is foldably attached thereto along scored fold line 126.

The cut and scored sheet blank 100*a* of FIG. 11 is folded and assembled as shown in FIG. 10 to provide a fully assembled greeting card and candy holder as shown in FIG. 9. As indicated in FIG. 10, compartment front panel 104 is folded along its fold line 106, and side panel 114 is folded along its hinged fold line connection 118 with back panel 112 to bring front panel 104 into spaced-apart, overlying relation with back panel 112. This will position side panel 114 perpendicular to the front and back compartment panels 104 and 112 as shown in FIGS. 9 and 10. The opposite side panel 120 is then folded inwardly to a position parallel to side panel 114, and its attachment flap 124 is folded inwardly, inside of compartment front panel 104 in the manner shown in FIG. 10. With front panel 104 overlying attachment flap 124, those two panels are secured to each other by gluing along glue area 110 to secure the candy compartment in assembled condition. The opposite ends of the candy compartment may be secured by closure means comprising sticker seals 130 and 128. A first sticker seal 130 having an inside adhesive surface 130*a* is preferably attached as shown in FIGS. 9 and 10 over the bottom of the candy compartment by pressing its adhesive surfaces 130*a* against the lower ends of panels 104 and 112. After an item of candy, such as a wafer type of candy bar 132 is inserted into the candy compartment between panels 104 and 112, the upper end of the candy compartment is closed by attaching second, sticker seal 128 to the top, outer faces of panels 104 and 112 by means of adhesive surface 128*a* on the inside of sticker seal 128. Preferably, the sticker seals 128 and 130 may comprise decorative silver or gold seals, which are readily removable to provide an openable closure permitting access to the interior of the candy compartment.

In the final assembled form, front message panel 102 is folded over along fold line connection 106 in overlying relation to the front of the candy compartment, opposite compartment front panel 104. Thus, in this embodiment as well, the device ultimately assumes the form of a foldable greeting car of relatively flat, compact shape. Printed or written messages may be provided on the outside and inside faces of message panel 102, as well as on the outer, front face of compartment panel 104.

All of the embodiments of the COMBINED GREETING CARD AND CANDY HOLDER disclosed herein provide the common benefit of a foldable greeting card so formed and assembled as to include a candy compartment of nonbulky, relatively flat consideration so that the card can be folded flat for display and mailing. Any type of candy may be contained with the candy compartment. It is contemplated that a high quality Swiss chocolate of the flat, water-bar shape will be provided in the candy compartment. This permits providing a special candy gift along with a greeting car for special occasions. A person message may be handwritten on the separate, hinged message panel which provides a writing flap. Although a one-piece construction has been disclosed, it is not essential that the device be made out of a single piece of sheet material. It is anticipated that the greeting car and candy holder as disclosed herein will be sold in gift shops, card shops, liquor stores, and also provided as a handout item to provide a special greeting and gift for businesses at meetings, conventions, and trade shows.

It is anticipated that various changes may be made in the size, shape and construction of the COMBINED GREETING CARD AND CANDY HOLDER disclosed herein without departing from the spirit and scope of the invention as defined by the following claims:

What is claimed is:

1. A combined greeting car and candy compartment made of a single sheet blank having a plurality of score lines for folding said blank and for separating said sheet blank into a plurality of panels, said sheet blank comprising:

a message panel having a substantially rectangular configuration;

a first side panel having a substantially rectangular configuration and hingedly connected to said message panel at a first fold line along adjacent longitudinal edges of said message panel and said first side panel;

a back panel having a substantially rectangular configuration, said back pane hingedly connected to said first side panel at a second fold line along adjacent longitudinal edges of said back panel and said first side panel;

a second side panel having a substantially rectangular configuration and hingedly connected to said back panel at a third fold line along adjacent longitudinal edges of said second side panel and said back panel;

a front panel having a substantially rectangular configuration, said front pane hingedly connected to said second side panel at a fourth fold line along adjacent longitudinal edges of said second side panel and said front panel;

a third side panel having a substantially rectangular configuration and hingedly connected to said front panel at a fifth fold line along adjacent longitudinal edges of said second side panel and said back panel;

a tuck panel hingedly connected to said third side panel at a sixth fold line along adjacent longitudinal edges of said third side panel and said tuck panel;

a first closure panel hingedly connected to said front panel at a first closure fold line along adjacent latitudinal edges of said first closure panel and said front panel;

a reinforcing panel hingedly connected to said first closure panel at a second closure fold line along adjacent latitudinal edges of said first closure panel and said reinforcing panel;

a second closure panel hingedly connected to said front panel at a third closure fold line along adjacent latitudinal edges of said second closure panel and said front panel;

a glue panel hingedly connected to said second closure panel at a fourth closure fold line along adjacent latitudinal edges of said second closure panel and said glue panel;

wherein said candy compartment is formed by folding said sheet blank along said third through sixth fold lines such that said front and back panels and said second and third side panels form opposing, spaced apart walls of said candy compartment and said tuck panel is folded inside said candy compartment to provide an openable closure for access to said candy compartment, said compartment being further formed by folding said sheet blank along said first through fourth closure fold lines so that said first and second closure panels close the opposite ends of said candy compartment and so that said reinforcing panel and said glue panel overlap each other for gluing said reinforcing and glue panels to each other; and wherein said blank is further foldable along said first and second fold lines such that said first side panel and said third side panel are in a generally face-to-face juxtaposition and said message panel is freely foldable to and from a generally face-to-face juxtaposition with said front panel.

2. The combination greeting card and candy compartment of claim 1 and further including a water-like candy disposed in said candy compartment.

* * * * *